US008821167B2

(12) United States Patent
Ritner

(10) Patent No.: US 8,821,167 B2
(45) Date of Patent: Sep. 2, 2014

(54) APPARATUS FOR ELECTRICALLY CONNECTING A FLEXIBLE CIRCUIT TO A RECEIVER

(71) Applicant: Hi Rel Connectors, Inc., Claremont, CA (US)

(72) Inventor: William E. Ritner, Claremont, CA (US)

(73) Assignee: Hi Rel Connectors, Inc., Claremont, CA (US)

( * ) Notice: Subject to any disclaimer, the term of this patent is extended or adjusted under 35 U.S.C. 154(b) by 0 days.

(21) Appl. No.: 13/760,574

(22) Filed: Feb. 6, 2013

(65) Prior Publication Data

US 2013/0323946 A1 Dec. 5, 2013

Related U.S. Application Data

(60) Provisional application No. 61/653,813, filed on May 31, 2012.

(51) Int. Cl.

| | |
|---|---|
| ***H01R 12/00*** | (2006.01) |
| ***H01R 13/52*** | (2006.01) |
| ***H01R 12/77*** | (2011.01) |
| ***H01R 12/79*** | (2011.01) |
| *H01R 13/193* | (2006.01) |

(52) U.S. Cl.

CPC ..... *H01R 12/771* (2013.01); *H01R 13/5219* (2013.01); *H01R 13/193* (2013.01); *H01R 12/79* (2013.01)

USPC ..... 439/67

(58) Field of Classification Search

CPC ..... H01R 12/771; H01R 13/24; H01R 12/62; H01R 12/79; H01R 23/668; H01R 23/722

USPC ..... 439/83, 67–68, 492

See application file for complete search history.

(56) References Cited

U.S. PATENT DOCUMENTS

| | | | | |
|---|---|---|---|---|
| 3,945,703 | A | 3/1976 | McCormick | |
| 4,012,093 | A * | 3/1977 | Crane | 439/67 |
| 4,526,432 | A | 7/1985 | Cronin et al. | |
| 4,655,524 | A | 4/1987 | Etzel | |
| 4,975,068 | A | 12/1990 | Squires | |
| 5,158,479 | A | 10/1992 | Mouissie | |

(Continued)

FOREIGN PATENT DOCUMENTS

| | | |
|---|---|---|
| EP | 0440305 A1 | 8/1991 |
| GB | 2463867 A | 3/2010 |

OTHER PUBLICATIONS

International Search Report dated Nov. 23, 2012 in PCT/US2012/029952 (9 pages).

(Continued)

*Primary Examiner* — Edwin A. Leon
(74) *Attorney, Agent, or Firm* — Cotman IP Law Group, PLC

(57) ABSTRACT

An electrical assembly combination includes (a) a receiver having a receiver housing and a plurality of receiver housing electrical contacts, and (b) a connector device comprising a connector housing capable of accepting and retaining a terminal end of a flexible assembly having a plurality of flexible assembly electrical contacts. The connector device is capable of being reversibly attached to the receiver housing such that each of the receiver housing electrical contacts is electrically connected to a flexible assembly electrical contact in a removable, non-permanent manner.

20 Claims, 3 Drawing Sheets

(56) References Cited

U.S. PATENT DOCUMENTS

| | | | | |
|---|---|---|---|---|
| 5,372,512 | A | 12/1994 | Wilson et al. | |
| 5,484,294 | A | 1/1996 | Sobhani | |
| 6,064,003 | A | 5/2000 | Moore et al. | |
| 6,193,544 | B1 | 2/2001 | McGinnis | |
| 6,409,531 | B1 | 6/2002 | Millard | |
| 6,721,189 | B1 | 4/2004 | Haba | |
| 6,896,552 | B2 | 5/2005 | Kosmala | |
| 7,980,863 | B1 | 7/2011 | Holec et al. | |
| 8,007,286 | B1 | 8/2011 | Holec et al. | |
| 8,529,277 | B2 * | 9/2013 | Williams et al. | 439/75 |
| 2003/0232524 | A1 | 12/2003 | Burdick | |
| 2007/0167089 | A1 | 7/2007 | Gobron | |
| 2009/0149036 | A1 | 6/2009 | Lee | |
| 2012/0315773 | A1 | 12/2012 | Esquivel et al. | |
| 2012/0315774 | A1 | 12/2012 | Williams et al. | |

OTHER PUBLICATIONS

International Search Report dated Nov. 28, 2012 in PCT/US2012/029957 (11 pages).

ISR of PCT/US2013/029155.

* cited by examiner

APPARATUS FOR ELECTRICALLY CONNECTING A FLEXIBLE CIRCUIT TO A RECEIVER

CROSS-REFERENCE TO RELATED APPLICATIONS

This application claims priority from U.S. Provisional Patent Application Ser. No. 61/653,813, filed on May 31, 2012, entitled "APPARATUS FOR ELECTRICALLY CONNECTING A FLEXIBLE CIRCUIT TO A RECEIVER," the entirety of which is incorporated herein by reference.

FIELD OF THE INVENTION

The invention relates generally to electrical connection assemblies and, more particularly, to electrical connection assemblies comprising a flexible electrical conductor and a rigid assembly, such as a circuit board.

BACKGROUND OF THE INVENTION

Sophisticated electrical and electronic components are frequently disposed proximate to high vibration equipment, such as aircraft and rocket engines. Because of the narrow confines wherein such components are typically disposed, interconnecting such components often employs the use of flexible electrical conductors ("flexible assemblies").

The prior art methods of attaching a flexible assembly to a rigid assembly (such as a circuit board) usually employ some form of permanent attachment, such as methods wherein the flexible assembly is soldered to the rigid assembly.

Problems arise in such prior art methods when the attachment between the flexible assembly and the rigid assembly needs to be disengaged (to repair the rigid assembly, or for other relevant purposes requiring disassembly or unmating of the assembly). Such activities cannot easily (if at all) be performed in the field, and, in most cases, require the complete replacement of both flexible assembly and rigid assembly. Such complete replacement of both assemblies is awkward, time-consuming and expensive.

Accordingly, there is a need for a method of attaching a flexible assembly to a rigid assembly which does not involve the aforementioned problems in the prior art.

SUMMARY OF THE INVENTION

The invention satisfies this need. The invention is an electrical assembly combination comprising (a) a receiver having a receiver housing and a plurality of receiver housing electrical contacts, and (b) a connector device comprising a connector housing capable of accepting and retaining a terminal end of a flexible assembly having a plurality of flexible assembly electrical contacts. In the invention, the connector device is capable of being reversibly attached to the receiver housing such that each of the receiver housing electrical contacts is electrically connected to a flexible assembly electrical contact in a removable, non-permanent manner.

An objective of this invention disclosure is to define an apparatus comprising a mechanical device and specifically designed receiver for electrically and mechanically connecting a rigid, semi-rigid and/or flexible circuit assembly (hereby referred to as "flexible circuit") and a plurality of replaceable and repairable conductive elements found within the flexible circuit directly to a specifically designed receiver termination point comprising a plurality of conductive elements located within the receiver in a manner that: a) the mechanical device contains the flexible circuit and flexible circuit elements and the receiver contains the receiver conductive elements and; b) the mechanical device may be non-destructively disconnected from the specialized receiver and; c) some or all of the conductive elements may be replaceable and/or repairable within the apparatus and; d) the flexible circuit conductive elements may be non-destructively engaged and/or disengaged with the receiver conductive elements and; e) physically isolates the connected end of the flexible circuit and mating interface of the receiver termination point from both foreign contaminates and stray electrical transients and; f) maintains both electrical connectivity and contaminant protection when subject to extreme environments including, but not limited to, mechanical, thermal, electrical, and chemical stresses.

A feature of preferred embodiments of this combination includes an enclosure for accepting and retaining the flexible circuit mating end such that the flexible circuit may be non-destructively removed from the enclosure, and positions the flexible circuit within the enclosure in a manner that allows the electrically conductive elements found within the flexible circuit to be exposed to the conductive elements found within the receiver in order to make physical contact and become electrically interconnected with the flexible circuit conductive elements in a non-permanent form that would allow the flexible circuit conductive elements to become disengaged from the receiver conductive elements without causing damage to either the flexible circuit conductive elements or the receiver conductive elements.

In this regard, the combination includes a plurality of conductive elements found within both the flexible circuit and receiver, wherein the flexible circuit conductive elements and receiver conductive elements may physically join in a manner that creates an electrical connection between the two mated elements, and the mated elements may be disconnected from each other without causing damages to either of the conductive elements, and the conductive elements may be removed from their retention feature within their respective housing without causing damages to either the conductive element or retention feature or housing, and may be configured using existing solderless connection methods, including but not limited to: pin-socket mating systems, spring probe systems and compressive contact systems, such as those marketed under the Gold-Dot™trademark by Delphi Connection Systems of Irvine, Calif.

An additional feature that may be included in the combination is a physical seal or barrier between both the enclosure for the flexible circuit and the receiver acting in a manner that prevents any undesirable foreign entities, including both physical contaminants and stray electrical transients, from entering the engagement area between the flexible circuit conductive elements and the receiver conductive elements. The designer of the apparatus may include additional sealing points of the apparatus, given the specific design intent of the apparatus.

Another feature that may be included in the combination is interlocking locking mechanism between both the flexible circuit enclosure device and the receiver that upon full engagement of the locking mechanism: a) the flexible circuit conductive elements are electronically connected with the receiver conductive elements and; b) the seal between the enclosure and receiver is active in preventing foreign contamination, including both physical contaminants and stray electrical transients.

A feature that may be included in the locking mechanism is to provide assurance that the enclosure and receiver do not become disengaged during operation of the apparatus in environments that would otherwise cause disengagement without the use of a locking mechanism, thereby making the apparatus useful in extreme environments in that the apparatus will continue to serve its other primary functions of sealing and engaging the conductive elements found within the flexible circuit and receiver.

The combination may further incorporate active and passive accessories and components, such as signal filters, signal indicators and power regulators. The apparatus may further incorporate design features, such as "scoop-proof" components or keying features to ensure proper alignment of conductive elements.

Thus, the invention provides a combination for electronically connecting a flexible circuit to a termination point, consisting of a device and receiver. The apparatus comprises an enclosure for the flexible circuit wherein the flexible circuit may be non-destructively removed from the enclosure. The flexible circuit is contained such that the conductive elements found in the flexible circuit are exposed. The conductive elements are non-permanently electrically connected to conductive elements found in the flexible circuit. The conductive elements consist of electrically conductive materials physically configured to engaged and disengage in a nondestructive manner by conventional or nonconventional means.

The combination can further comprise seals between the device and receivers to prevent contamination from foreign entities, including both physical contaminants and stray electrical transients. The seals typically comprise sealing components found in the device, the receiver, or both.

The combination can also further comprise a locking mechanism that engages the device to the receiver. The locking mechanism typically comprises features that ensure engagement between the conductive elements in the flexible circuit and the conductive elements found in the receiver. Such locking mechanism preferably comprises a feature that ensures activation of the seals. The locking mechanism typically further comprises features that maintain the mechanical integrity of the combination and conductive element engagement in situations that would otherwise compromise the functionality of the apparatus.

BRIEF DESCRIPTION OF THE DRAWINGS

These and other features, aspects and advantages of the present invention will become better understood with reference to the following description, appended claims and accompanying drawings where:

DETAILED DESCRIPTION OF THE INVENTION

Figure 1:
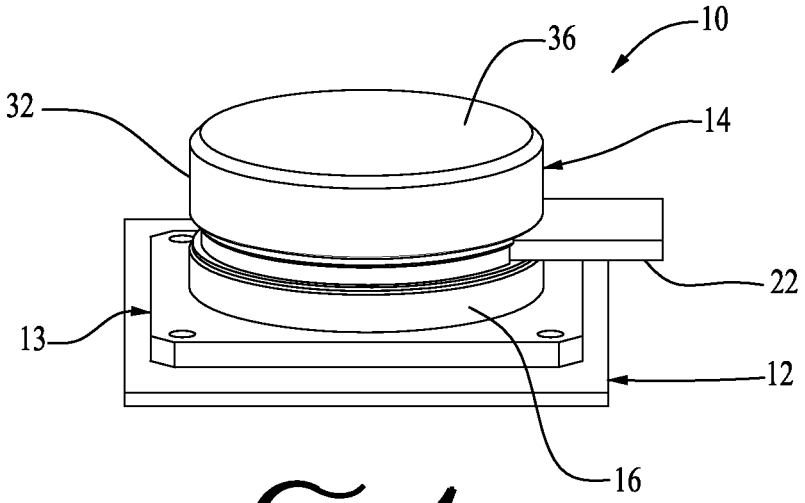
FIG. 1 is a perspective view of an electrical assembly combination having features of the invention.

The following discussion describes in detail one embodiment of the invention and several variations of that embodiment. This discussion should not be construed, however, as limiting the invention to those particular embodiments. Practitioners skilled in the art will recognize numerous other embodiments as well.

The invention is an electrical assembly combination 10 useful in connecting a flexible assembly 22 to a rigid assembly 12. The invention comprises a receiver 13 and a connector device 14.

Figure 2:
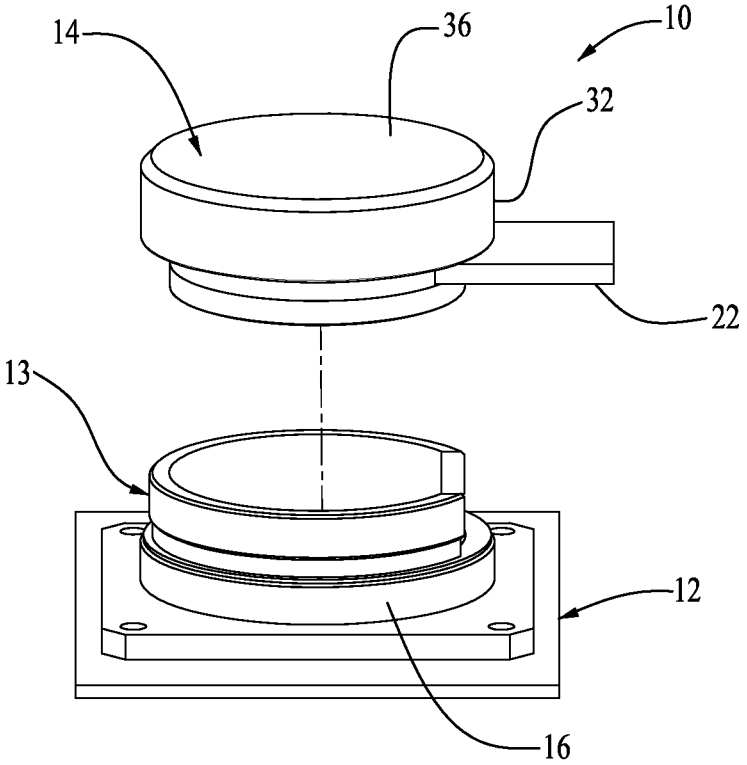
FIG. 2 is an exploded perspective view of a receiver and connector device comprising the electrical assembly combination illustrated in FIG. 1.
Figure 3:
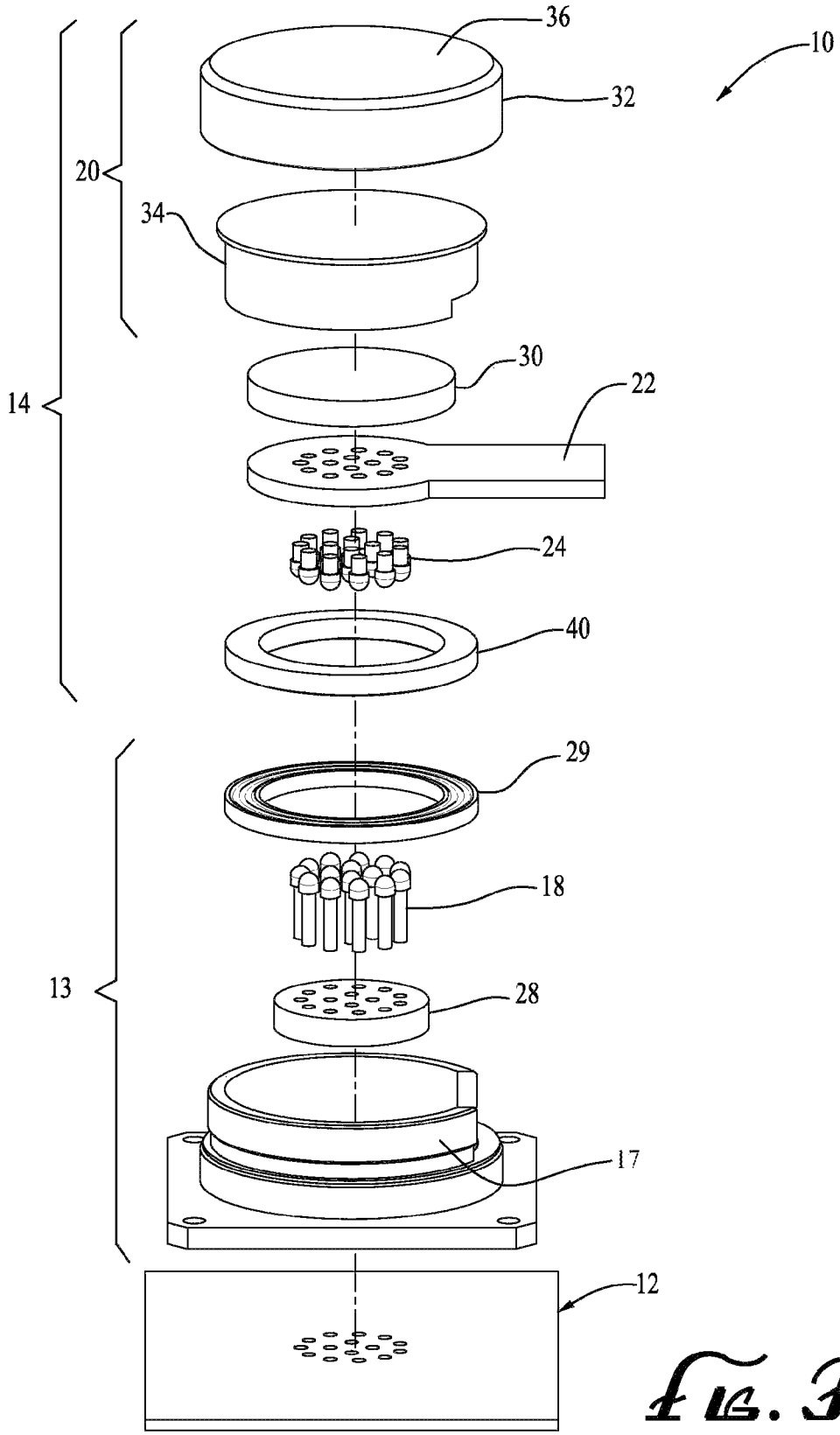
FIG. 3 is a fully exploded perspective view of the electrical assembly combination having features of the invention.
Figure 4:
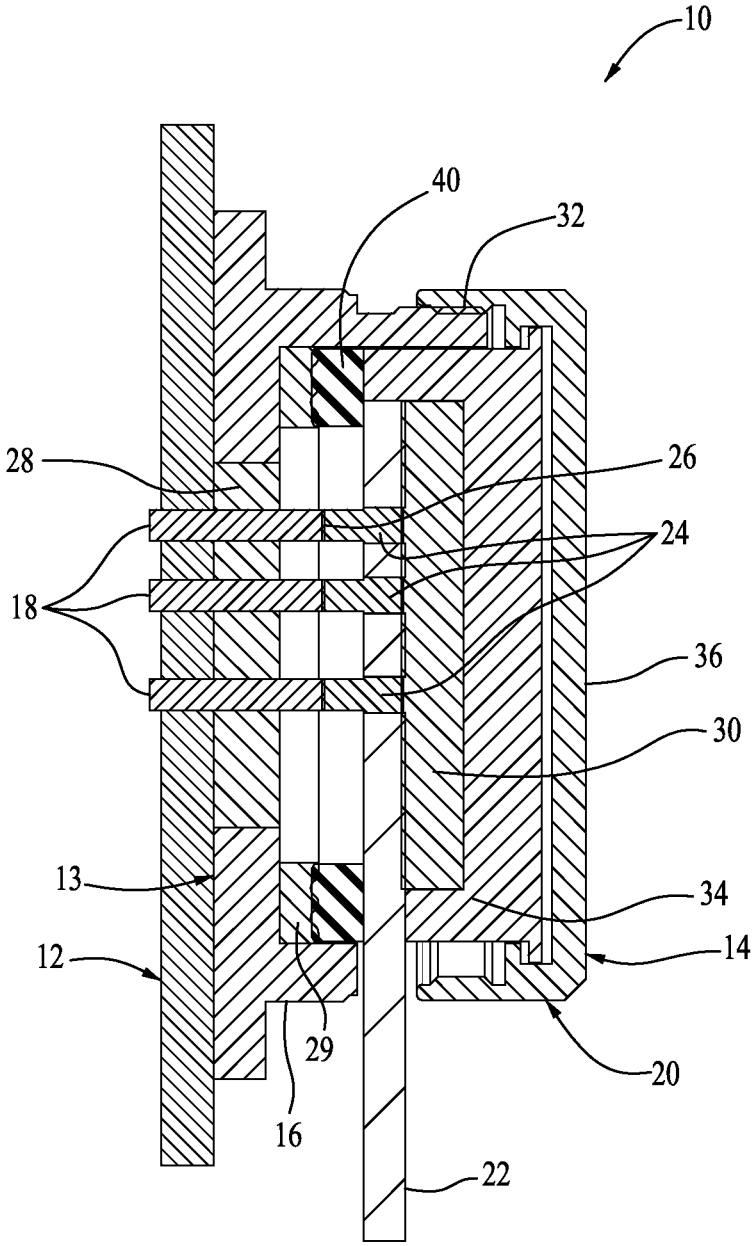
FIG. 4 is a cross-sectional view of the fully-assembled electrical assembly combination illustrated in FIG. 1.

One embodiment of the electrical assembly combination 10 is illustrated in FIG. 1. FIG. 2 illustrates the receiver and connector device individually. FIG. 3 is a fully exploded view of the electrical assembly combination, and FIG. 4 is a cross-sectional view of the electrical assembly combination, showing how the principal component parts are assembled.

The receiver 13 comprises a receiver housing 16 and a plurality of receiver housing electrical contacts 18.

The connector device 14 comprises a connector housing 20 for retaining a flexible assembly 22. The flexible assembly 22 includes a plurality of flexible assembly electrical contacts 24.

The connector housing 20 is capable of accepting and retaining a terminal end of a flexible assembly 22 having the plurality of flexible assembly electrical contacts 24.

The connector device 14 is reversibly attached to the receiver housing 16, such that each of the receiver housing electrical contacts 18 is electrically connected to a flexible assembly electrical contact 24 in a removable, non-permanent manner. Thus, all contacts 18 and 24 may be both serviceable and solderless. Each receiver housing electrical contact 18 is mated to an assembly electrical contact 24 by one of several solderless connection methods known in the art, including, but not limited to, pin-socket mating systems; spring probe systems and compressive contact systems, such as those marketed under the Gold-Dot™trademark by Delphi Connection Systems of Irvine, Calif. In the embodiment illustrated in FIG. 4, each receiver housing contact 18 is mated to an assembly electrical contact 24 at a conductive element engagement surface 26.

In the embodiments illustrated in the drawings, the rigid assembly 12 is a circuit board, although the invention can also be used with other types of rigid assemblies.

In the embodiment illustrated in the drawings, the receiver 13 further comprises an insulator assembly 28 which can be constructed of glass-filled epoxy resin or similar material. The insulator assembly is used to mechanically retain, electronically isolate and insulate the receiver housing electrical contacts 18.

In the embodiment illustrated in the drawings, the receiver 13 further comprises a sealing component 29 for sealing the receiver housing 16 to the connector device 14.

The connector housing 20 is used as a structural member and as support for the flexible assembly 22, as well as for vibration dampening purposes. The connector housing 20 can be made from a multitude of materials, including but not limited to the following: aluminum, titanium, steel, plastic, Polyether ether ketone (PEEK), as well as composites (conductive or non-conductive). The shape of the connector housing 20 can be circular, rectangular, as well as other shapes. The connector housing 20 can have multiple entry locations for a plurality of flexible assemblies 22.

In the embodiment illustrated in the drawings, the connector housing 20 further comprises a flexible device enclosure 34 and a locking cap 36. In one or more embodiments, locking cap 36 may include a locking mechanism, e.g. threaded inside surface, on sidewall 32 to provide twist-to-lock type functionality with receiver housing 16. The flexible device enclosure 34 and the locking cap 36 serve the purpose of enclosing and sealing the flexible assembly 22 and provide environmental, EMI/EMC protection. The locking cap 36 can be made from a variety of materials such as, but not limited to, aluminum, titanium, steel and composites (conductive and non-conductive). The flexible device enclosure 34 and the locking cap 36 may be assembled to one another with various mechanical retention elements such as, but not limited to, bolts, threaded studs and captive screws.

As noted above, the connector housing 20 retains the terminal end of the flexible assembly 22, such that the flexible assembly 22 may be non-destructively removed from the enclosure 34. The connector housing 20 positions the flexible assembly 22 within the connector housing 20 in a manner that allows the flexible assembly electrical contacts 24 to be exposed to the receiver housing electrical contacts 18 in order to make physical contact and become electrically interconnected with the receiver housing contacts 18 in a non-permanent form. Such non-permanent interconnection allows the flexible assembly electrical contacts 24 to become disengaged from the receiver housing electrical contacts 18 without causing damage to either the flexible assembly electrical contacts 24 or to the receiver housing electrical contacts 18.

In the embodiment illustrated in the drawings, the connector device 14 can further comprise a compression grommet 30 constructed of silicon or similar material. The compression grommet 30 is used to support the flexible assembly 22 inside of the connector device 14 and to dampen movement when the connector device 14 is subject to vibration.

In the embodiment illustrated in the drawings, the connector device 14 further comprises a flexible assembly retention component 40 which securely retains the flexible assembly 22 within the connector device 14.

The connector device 14 can further comprise active and passive accessories and components, such as signal filters, signal indicators and power regulators. The connector device 14 may further incorporate design features, such as "scoop-proof" components or keying features to ensure proper alignment of conductive elements 18 and 24.

The flexible assembly 22 can comprise an optional sealing grommet (not shown) to seal the flexible assembly within the connector housing. Such sealing grommet provides a sealing interface between the flexible assembly 22 and the connector housing 20.

The optional sealing component 29 provides a seal to protect the space between the various components of the electrical assembly combination to prevent contamination from foreign entities. Such seal acts in a manner that prevents any undesirable foreign entities from entering the engagement area between the flexible assembly electrical contacts and the receiver housing electrical contacts. The use of grommets and/or gaskets can also be incorporated into the combination to serve an array of functions, such as, but not limited to, environmental sealing, EMI/EMC bonding, vibration dampening and air volume reduction.

The electrical assembly combination 10 facilitates the installation and replacement of a flexible assembly 22 to a rigid assembly 12 without the use of solder or other permanent connection. Furthermore, the electrical assembly combination of the invention 10 is configured such that the flexible assembly 22 and the rigid assembly 12 do not become disengaged during operation of the combination in environments that would otherwise cause disengagement, thereby making the electrical assembly combination useful in extreme environments. The several sets of mated electrical contacts 18 and 24 may be individually disconnected from each other at a conductive element engagement surface 26 without causing damages to any of the contacts 18 and 24, and any contact 18 and 24 may be removed from its respective retention structure without causing damages to the contact 18 and 24 or to the retention structure.

Having thus described the invention, it should be apparent that numerous structural modifications and adaptations may be resorted to without departing from the scope and fair meaning of the instant invention as set forth hereinabove and as described hereinbelow by the claims.

What is claimed is:

1. An electrical assembly combination comprising:

a receiver comprising a receiver housing, wherein said receiver housing comprisies a first end and a second end and a plurality of receiver housing electrical contacts, wherein said receiver housing is configured at said first end to mechanically couple to a rigid assembly with a plurality of rigid assembly electrical contacts such that each one of said plurality of receiver housing electrical contacts is electrically coupled to a corresponding one of said plurality of rigid assembly electrical contacts; and a connector comprising a connector housing with a connector interlocking cap and a compression grommet inside said connector housing, wherein said connector interlocking cap is configured to removably couple directly to said second end of said receiver housing thereby forming an interlocking mechanism, wherein inside of said connector housing is configured to securely receive a terminal end of a flexible assembly with said compression grommet between said terminal end and a top wall of said connector housing, wherein said connector is configured such that each one of said plurality of receiver housing electrical contacts is mated inside said receiver housing by a solderless connection to a corresponding one of a plurality of flexible assembly electrical contacts at said terminal end within an enclosure formed when said connector is coupled to said receiver housing.

2. The electrical assembly combination of claim 1, wherein said receiver housing is configured as a receiver interlocking member at said second end.

3. The electrical assembly combination of claim 2, wherein said connector interlocking cap and said receiver interlocking member are configured to couple through a twist-to-lock mechanism.

4. The electrical assembly combination of claim 1, wherein said solderless connection comprises a pin-socket mating system.

5. The electrical assembly combination of claim 1, wherein said solderless connection comprises a spring probe system.

6. The electrical assembly combination of claim 1, wherein said solderless connection comprises a compressive contact system.

7. The electrical assembly combination of claim 1, wherein said connector further comprises a flexible assembly retention component configured to securely retain the flexible assembly terminal within the connector housing, wherein said flexible assembly retention component is configured to fit around a perimeter of said terminal end of said flexible assembly.

8. The electrical assembly combination of claim 1, wherein said connector further comprises a flexible device enclosure inside said connector interlocking cap for enclosing and sealing said terminal end of said flexible assembly inside said connector.

9. The electrical assembly combination of claim 1, wherein said receiver further comprises an insulator assembly configured to electrically isolate each one of said plurality of receiver housing electrical contacts from each other.

10. An electrical assembly combination comprising:

a receiver comprising a receiver housing, wherein said receiver housing comprises a first end and a second end and a plurality of receiver housing electrical contacts, wherein said receiver housing is configured at said first end to mechanically couple to a rigid assembly with a plurality of rigid assembly electrical contacts such that each one of said plurality of receiver housing electrical contacts is electrically coupled to a corresponding one of said plurality of rigid assembly electrical contacts, wherein said receiver housing further comprises a receiver interlocking member at said second end; and a connector comprising a connector housing with a connector interlocking cap and a compression grommet inside said connector housing, wherein said connector interlocking cap is configured to removably couple directly to said receiver interlocking member thereby forming an interlocking mechanism, wherein inside of said connector housing is configure to secure a terminal end of a flexible assembly such that said compression grommet is between said terminal end and a top wall of said connector housing, said terminal end comprising a plurality of flexible assembly electrical contacts, wherein said connector is configured such that each one of said plurality of receiver housing electrical contacts is mated inside said receiver housing by a solderless connection to a corresponding one of a plurality of flexible assembly electrical contacts at said terminal end within an enclosure formed when said connector is coupled to said receiver housing.

11. The electrical assembly combination of claim 10, wherein said solderless connection comprises a compressive contact system.

12. The electrical assembly combination of claim 10, wherein said connector further comprises a flexible assembly retention component configured to securely retain the flexible assembly terminal within the connector.

13. The electrical assembly combination of claim 10, wherein said connector further comprises a flexible device enclosure inside said connector interlocking cap for enclosing and sealing said terminal end of said flexible assembly inside said connector.

14. The electrical assembly combination of claim 10, wherein said receiver further comprises an insulator assembly configured to electrically isolate each one of said plurality of receiver housing electrical contacts from each other.

15. The electrical assembly combination of claim 10, wherein said connector interlocking cap and said receiver interlocking member are configured to couple through a twist-to-lock mechanism.

16. An electrical assembly combination comprising:

a connector comprising a connector interlocking cap, a flexible device enclosure partially inside said connector interlocking cap and a compression grommet inside said flexible device enclosure, wherein said connector interlocking cap is configured to directly couple to an interlocking member of a receiver to form a twist-to-lock mechanism thereby securing said flexible device enclosure with said connector interlocking cap and said receiver, wherein inside of said flexible device enclosure is configured to secure a terminal end of a flexible assembly such that said compression grommet is between said terminal end and a top wall of said flexible device enclosure, said terminal end comprising a plurality of flexible assembly electrical contacts, wherein said connector is configured such that each one of said plurality of flexible assembly electrical contacts is mated within said receiver to a corresponding one of a plurality of receiver housing electrical contacts within said receiver by a solderless connection method selected from a group consisting of pin-socket mating system, spring probe system and compressive contact system when said connector with said flexible assembly is coupled to said receiver housing.

17. The electrical assembly combination of claim 16, wherein said receiver is configured at an opposing end to said receiver interlocking member to mechanically couple to a rigid assembly with a plurality of rigid assembly electrical contacts such that each one of said plurality of rigid assembly electrical contacts is electrically coupled to a corresponding one of said plurality of receiver housing electrical contacts.

18. The electrical assembly combination of claim 16, wherein said connector further comprises a flexible assembly retention component configured to securely retain the flexible assembly terminal within the connector.

19. The electrical assembly combination of claim 16, wherein said connector further comprises a sealing grommet for protecting said terminal end of said flexible assembly inside said connector.

20. The electrical assembly combination of claim 16, wherein said receiver further comprises an insulator assembly configured to electrically isolate one receiver housing electrical contact from another receiver housing electrical contact.

* * * * *